US005414875A

United States Patent [19]

Kappl et al.

[11] Patent Number: 5,414,875

[45] Date of Patent: May 16, 1995

[54] QUICK RELEASE SEAT LATCH

[76] Inventors: Frederick A. Kappl; Linda J Kappl, both of 7717 Eagle St., Wauwatosa, Wis. 53213

[21] Appl. No.: 235,897

[22] Filed: May 2, 1994

[51] Int. Cl.[6] ..... A47K 13/12

[52] U.S. Cl. ..... 4/236; 4/240

[58] Field of Search ..... 4/234, 236, 237, 240

[56] References Cited

U.S. PATENT DOCUMENTS

| | | | |
|---|---|---|---|
| 1,010,658 | 12/1911 | McAuliffe | 4/236 |
| 3,055,015 | 9/1962 | Silverman | 4/240 |
| 3,063,063 | 11/1962 | Brooks | 4/236 |
| 3,613,130 | 10/1971 | Sansone | 4/240 |
| 4,087,884 | 5/1978 | Aeiderman | 4/236 |
| 4,353,137 | 10/1982 | Jammet | 4/237 |
| 4,438,535 | 3/1984 | Paredes | 4/234 |
| 4,965,889 | 10/1990 | Tissot et al. | 4/234 |
| 4,970,731 | 11/1990 | Fait | 4/234 |
| 5,267,357 | 12/1993 | Ades | 4/253 |

FOREIGN PATENT DOCUMENTS

| | | | |
|---|---|---|---|
| 0014325 | 1/1980 | European Pat. Off. . | |
| 0225427 | 6/1987 | European Pat. Off. . | |
| 2700663 | 7/1978 | Germany | 4/236 |
| 0346006 | 4/1931 | United Kingdom | 4/236 |
| 1230623 | 5/1971 | United Kingdom . | |

*Primary Examiner*—Robert M. Fetsuga
*Attorney, Agent, or Firm*—Richard C. Litman

[57] ABSTRACT

An attachment assembly for securing a toilet seat and cover assembly to its associated commode. The attachment assembly has two pincers which penetrate holes formed in the commode, which holes accept fasteners for accomplishing the above securement. A lever folds downwardly to cause the pincers to clamp the commode, thus securing the seat assembly to the commode. When raised, the lever relaxes the grip of the pincers on the commode, and the seat assembly can be fully removed from the commode without further disassembly. The novel attachment assembly engages pins conventionally furnished to enable the seat and its cover to pivot. When removed, the attachment assembly remains assembled to the seat and cover assembly, and the commode is unencumbered by fasteners, anchors, or the like.

15 Claims, 3 Drawing Sheets

QUICK RELEASE SEAT LATCH

BACKGROUND OF THE INVENTION

1. Field of the Invention

The present invention relates to a self-contained, readily releasable latch for securing a toilet seat assembly to its commode.

2. Description of the Prior Art

It is frequently desirable to be able to remove a toilet seat from its associated commode, as for cleaning or replacement. Normally, this is a difficult task since most seats are secured by threaded fasteners. In time, and particularly in humid environments typical of water closets, bathrooms, and the like, threaded fasteners are prone to becoming both soiled and frozen by corrosion. Moreover, such facilities are usually not generously provided with space, so that access to these fasteners is cramped.

The prior art has recognized this problem, and has suggested various solutions employing readily removable seats.

U.S. Pat. No. 5,267,357, issued to Bruce A. Ades on Dec. 7, 1993, discloses a hinge which is separable into two parts when two elongated pins are withdrawn from the assembly. Even after this disassembly, mounting brackets remain attached to a commode body assembly.

In a similar vein, E.P.O. Pat. Document No. 0,014,325, dated Aug. 20, 1980, discloses a toilet seat readily removable by withdrawal of two bolts from their journals. The bolts pass through stationary journals fastened to the commode body and the seat assembly.

U.S. Pat. No. 3,063,063, issued to Ray G. Brooks on Nov. 13, 1962, discloses an arrangement enabling quick release of a seat attaching post. The usual threaded fastener securing the post in its associated hole formed in the commode is replaced by a device which permits manual release from the post. A collar is slid coaxially along the post, and moves a locking ball into an ineffectual position. The device then manually disassociates from the post, and is pulled away therefrom.

U.S. Pat. No. 4,965,889, issued to Patrick Tissot et al. on Oct. 30, 1990, discloses a readily removed toilet seat wherein support blocks holding pivot pins for both the seat and the lid are readily removed from a cooperating bracket. The bracket is bolted to the commode body by passing conventional screws through holes conventionally formed in the commode body for attachment of the seat assembly.

U.S. Pat. No. 4,970,731, issued to Claudio Fait on Nov. 20, 1990, discloses an arrangement for releasing all components of a toilet seat hinge and fastener assembly from the commode body from above. An expansible anchor sits in the conventional fastener hole formed in the commode body, and receives a bolt or rod. When screwed in, the bolt deforms the anchor, and is forcibly retained therein. A post is thus provided which extends only above the commode body. The hinge has a support arm connecting the hinge mechanism to the toilet seat. This arm has a hole formed therein, and lowers into engagement onto the post. A setscrew penetrates the support arm, and engages a groove formed in the post. The toilet seat assembly is thus released by slackening the setscrew.

U.S. Pat. No. 4,353,137, issued to Pierre Jammet on Oct. 12, 1982, discloses a disposable toilet seat which is readily removable from the commode. The seat has holes which frictionally engage pegs projecting horizontally from a base member permanently attaches to the commode body by conventional screws or bolts. The seat is slid into and out of engagement with the pegs, and is thus installed and removed.

U.S. Pat. No. 3,613,130, issued to Fred A. Sansone on Oct. 19, 1971, discloses a toilet seat which attaches to anchor members permanently secured to the commode body by resilient frictional engagement of posts with receptacles formed in the anchor members.

U.S. Pat. No. 3,055,015, issued to Melvin H. Silverman on Sep. 25, 1962, is similar in concept to that of Sansone '130. In Silverman '015, a spring permanently mounted within the post resiliently deforms to expand once it has passed through an anchor and emerged therebelow. The anchor is secured to the commode body by threaded fasteners.

E.P.O. Pat. Document No. 0,225,427, dated Jun. 16, 1987, discloses a toilet seat arrangement wherein hinge posts are keyed within their journals, and are removed by appropriate rotation and withdrawal.

While each of the above approaches has its advantages, there remain nonetheless certain aspects which would be desirable to change. For example, disassembly of a seat assembly into several parts, particularly wherein some of those parts are small fasteners, could be avoided by appropriate design changes. Also, it would be desirable to remove all apparatus from the commode body to facilitate cleaning the same. In some of the above examples, anchors and other fastening structures remain a permanent part of the commode body.

None of the above inventions and patents, taken either singly or in combination, is seen to describe the instant invention as claimed.

Furthermore, some of the above inventions require complicated or precise manipulation of parts to operate properly. Finally, in the case of Jammet '137, ready disassembly comes at the cost of having reduced securement of the seat components.

SUMMARY OF THE INVENTION

The present invention seeks to overcome the above drawbacks to proposed schemes for rendering the seat readily detachable from the commode. It provides easily operated detachment, while assuring secure attachment when desired. It further enables the entire seat assembly, complete with hinge and attachment structure, to detach completely from the commode body. It further provides a single part apparatus, with no small parts or fasteners associated therewith, which could become lost.

To accomplish these ends, a hinge attachment assembly is provided which is lever operated, and which incorporates pincers penetrating and cooperating with the holes conventionally formed in the commode body. The lever must be moved against gravity. Also, great leverage ratio prevents the device from releasing from the commode in response to being rocked or pushed. Thus, the hinge attachment assembly resists being unintentionally detached.

The structure is compact, and fits unobtrusively behind the seat assembly. Therefore, despite having a somewhat large operating handle, especially compared to screw heads and similar small control elements of the prior art devices, the apparatus as a whole is as unobtrusive as most prior art devices.

Accordingly, it is a principal object of the invention to provide a seat latch which removably secures a conventional toilet seat and cover assembly to a commode body.

It is another object of the invention that the entire seat assembly and all attachment apparatus detach from the commode.

It is a further object of the invention to maintain the toilet seat and cover assembly unitary.

Still another object of the invention is to maintain the latch assembly unitary, especially avoiding disassembly into small components such as fasteners.

An additional object of the invention is to engage the commode by holes conventionally provided to accept attachment fasteners, and to engage the seat assembly by attachment to pins conventionally furnished integral thereto to enable pivoting of the seat and of the cover.

It is again an object of the invention to provide a readily accessible and grasped control handle for operating the invention.

Yet another object of the invention is to provide a linkage which gives the handle leverage over gripping elements attaching the seat latch to the commode.

Still an additional object of the invention is to dispose the control handle such that gravity opposes motion thereof to the detente or released position.

Yet a further object of the invention is cause the gripping elements to act by clamping the commode to the seat latch.

Still an additional object of the invention is to provide structure enabling an interference fit between the gripping elements and the commode when the gripping elements clamp to the commode.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
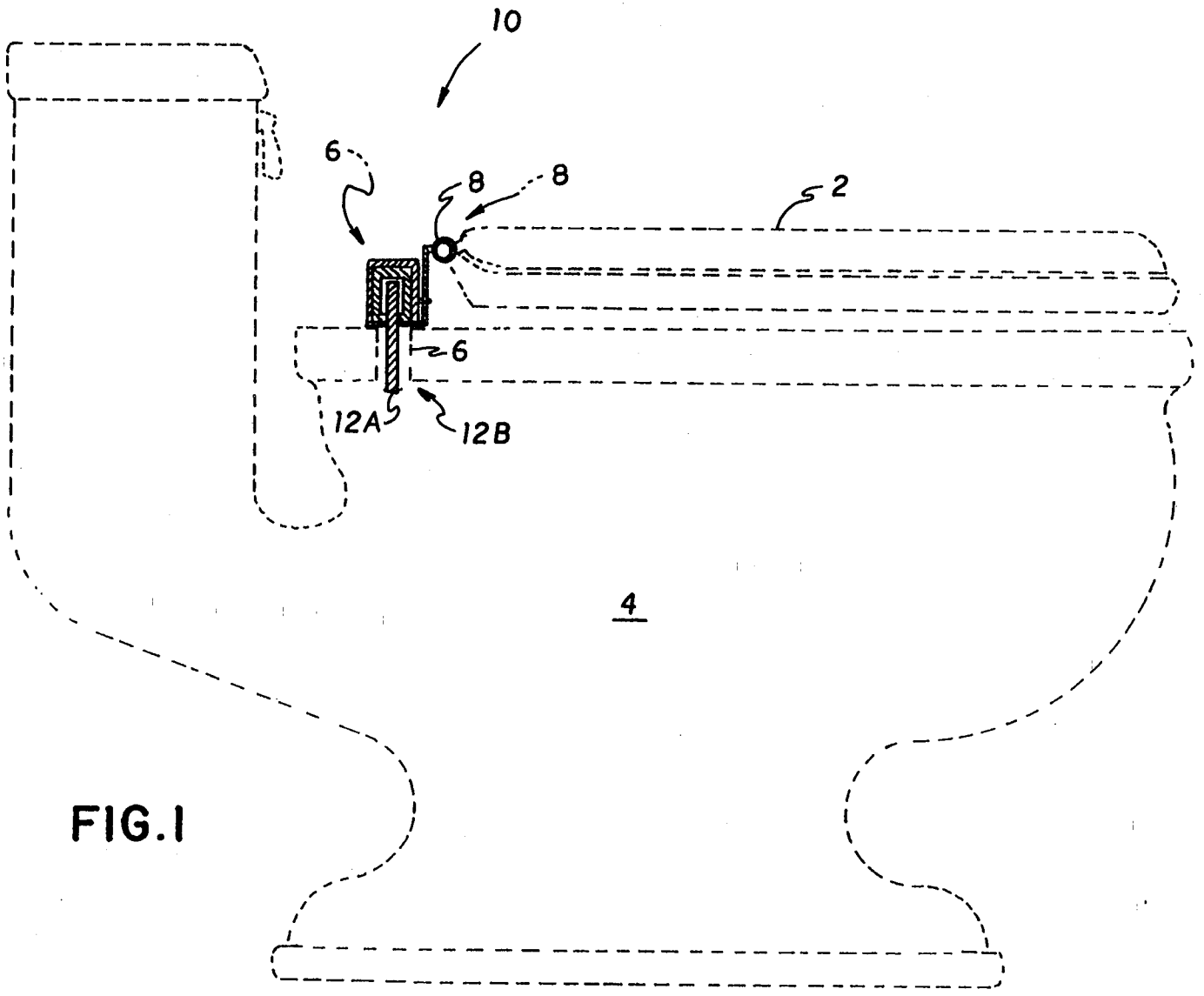
FIG. 1 is an environmental, side elevational, partly cross sectional view of the invention.

Function of the novel quickly released seat latch 10 is best understood by referring to FIG. 1 of the drawings, wherein it will be seen that latch 10 is disposed to the rear of a conventional toilet seat and cover assembly 2 provided for a commode 4. Commode 4 is a conventional type, including two holes 6 located at the right and left sides thereof, for accepting fasteners (not shown) attaching seat and cover assembly 2 to commode 4.

Seat latch 10 comprises a compact apparatus which is inconspicuous due to its size and location. Gripping elements 12A,12B engaging commode 4 replace attachment fasteners (not shown) which would otherwise be present, and act by clamping action in a manner to be described further hereinafter.

Figure 2:
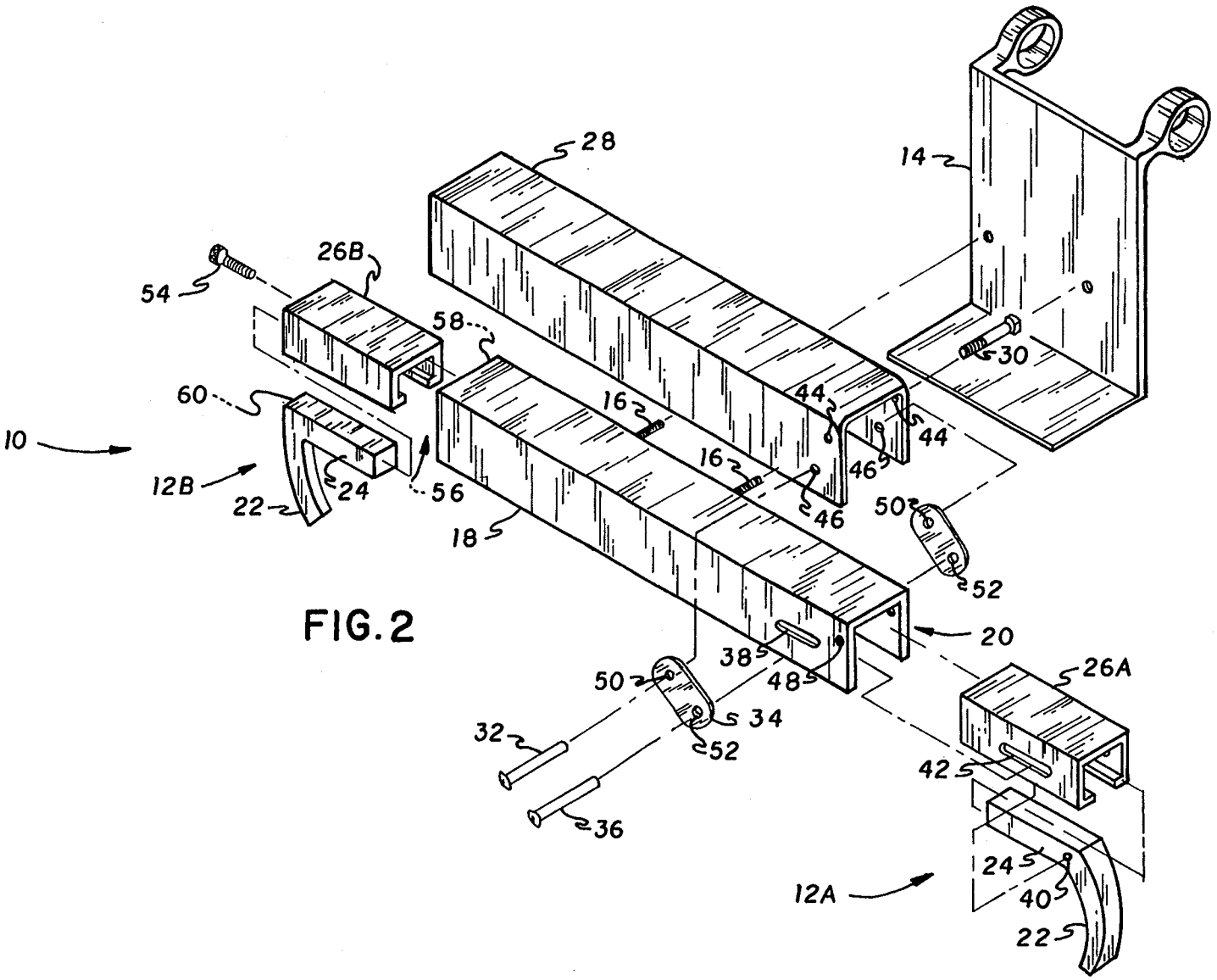
FIG. 2 is a perspective, exploded view of the invention.

Structure of seat latch 10 is shown in FIG. 2. Seat latch 10 releasably engages commode 4 as described above, and attaches to seat and cover assembly 2 by engaging a first pair of pivot pins 8 which are integral to seat and cover assembly 2, for enabling the seat and cover to be raised and lowered. A yoke 14 holds pivot pins 8, and is attached to seat latch 10 as by screws 16.

A frame 18 provides the main structural element to which components attach. Frame 18 is hollow, defining a track 20 therein. Each gripping element 12A or 12B has a curved finger 22 for engaging commode 4, and a slide 24 which occupies track 20, thus enabling its respective gripping element 12A or 12B to be retained within frame 18. Gripping elements 12A,12B are linearly aligned within track 20, and are constrained only to slide toward and away from one another when moved.

In the embodiment illustrated herein, slides 24 are too small to fit closely within track 20. Bushings 26A,26B provide snug but slidable fit of slides 24 and track 20.

Controls for moving gripping elements 12A,12B laterally, so that commode 4 is clamped therebetween, include a control lever 28 and associated linkage connecting control lever 28 to gripping elements 12A,12B. Control lever 28 is pivotally anchored at frame 18, as by bolt or second pivot pin 30. Control lever 28 engages one gripping element 12A by a slide engaging pin 32. This is indirectly accomplished in a manner which gives control lever 28 leverage over gripping elements 12A,12B. To this end, a link 34 is interposed between control lever 28 and gripping element 12A. In the illustrated embodiment, there are two links 34, for providing of symmetrical loading thereof, to prevent binding. Links 34 are contained by entrapment between control lever 28 and frame 18. Links 34 are pivotally connected to control lever 28 at a third pivot pin 36. Slide engaging pin 32 is anchored within links 34, and passes through a slot 38 formed in frame 18, so as to communicate with gripping element 12A. Of course, a slot 40 formed in the slide of gripping element 12A enables pin 32 to span the two links 34,34, and a corresponding slot 42 is formed in bushing 26A. In the same vein, necessary holes 44,46,48,50 enable passage of the various pins through control lever 28, frame 18, and links 34.

Gripping element 12A is acted on and moved linearly toward corresponding gripping element 12B. Gripping element 12B is stationary, being adjustably set and maintained in place by a screw 54. Screw 54 engages a threaded hole 56 (see FIG. 4) formed in end wall 58 (see FIG. 4) of frame 18, and then penetrates a threaded hole 60 formed in gripping element 12B.

Bushing 26B is immobilized within track 20 by any suitable means, such as friction fit, tack welding, engagement of a screw 16.

Operation of the invention will now be described, with reference to FIGS. 3 and 4. FIG. 4 shows the invention with control lever 28 in a released or detente position, wherein gripping elements 12A,12B have released the commode, and are easily withdrawn from holes 6. In this position, seat and cover assembly 2 and seat latch 10 are readily removable from commode 4.

Figure 3:
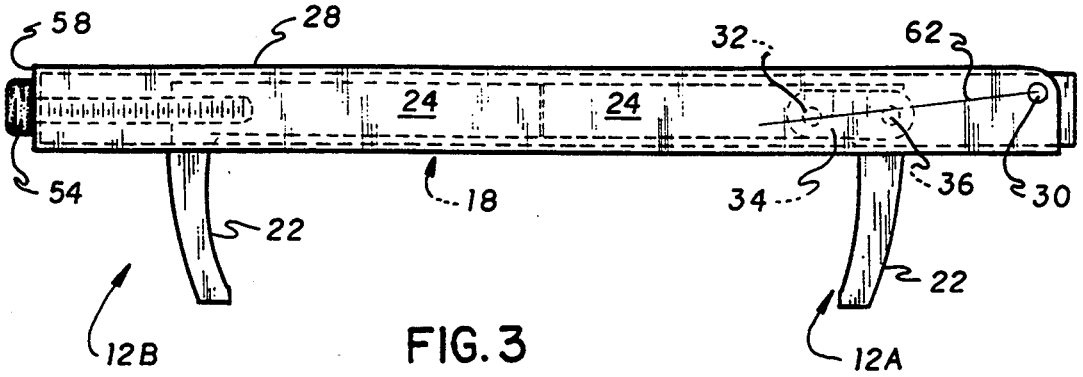
FIG. 3 is a diagrammatic, rear elevational view of major operative components of the invention, showing the handle in the locked or clamping position, and drawn to enlarged scale.
Figure 4:
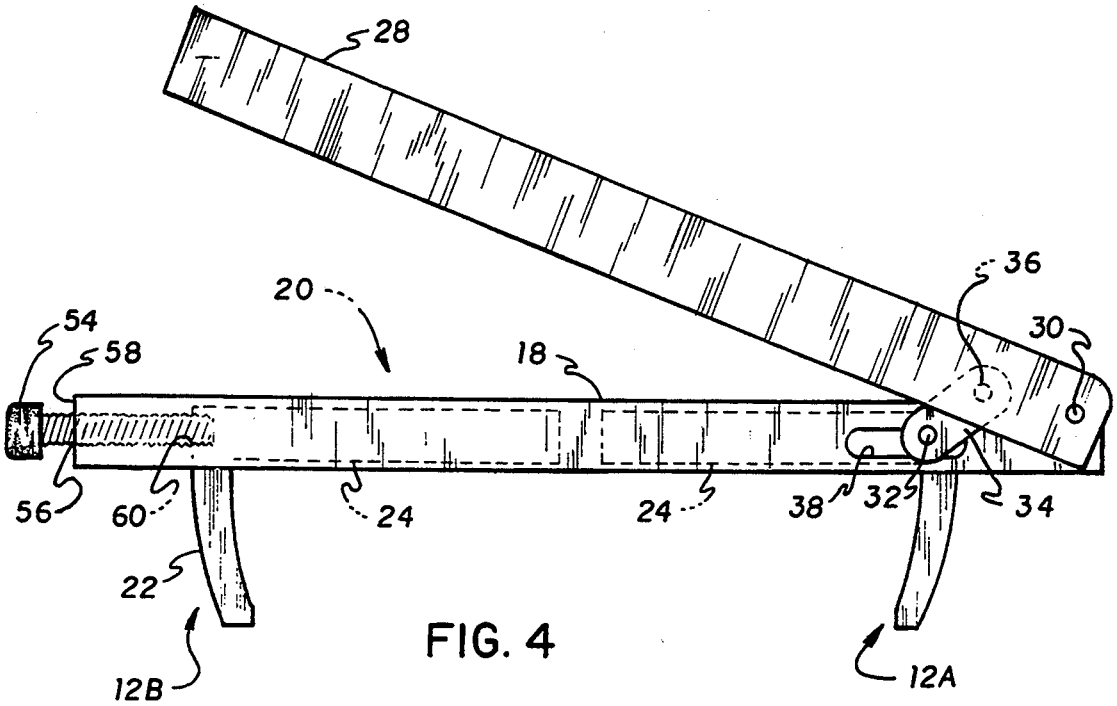
FIG. 4 is a diagrammatic, rear elevational view corresponding to FIG. 3, showing the handle in the detente or released position.

FIG. 3 shows control lever in the locked position, wherein gripping elements are urged towards one another, and clamp commode 4 therebetween. In this view, it will be seen that fingers 22 are curved, so that a portion thereof projects laterally. When in the clamped position, the projecting portion opposes withdrawal of fingers 22 from their respective holes 6 by interference fit. Given that a commode 4 typically has a hard, smooth external surface, fingers 22 could otherwise slip from their clamped position, and cover and seat assembly 2 could be removed from commode 4 unintentionally and unexpectedly.

To operate the invention, gripping elements 12A,12B are adjusted so that they will nearly abut in the clamped position, and will cooperate with holes 6 (see FIG. 1). Gripping element 12B is located appropriately, and screw 54 is installed in end wall 58, and is threaded into hole 60. Gripping element 12B is now immobilized within frame 18, and seat latch 10 is assembled to seat and cover assembly 2. Control lever 28 is moved into the locked position, and seat and cover assembly 2 is secured to commode 4.

Geometry of the linkage is such that third pivot pin 36 moves to a location below a line 62 defined by the axes of slide engaging pin 32 and pivot pin 30 when control lever 28 is moved to the locked position. A consequence of this arrangement is that both links 34 and control lever 28 must be moved upwardly, against gravity, to release gripping elements 12A,12B. Also, the arrangement of links 34 provide leverage which require considerable travel on the part of control lever 28 to relax gripping elements 12A,12B. These characteristics oppose unintended release of seat and cover assembly 2 from commode 4.

It is to be understood that the present invention is not limited to the sole embodiment described above, but encompasses any and all embodiments within the scope of the following claims.

I claim:

1. A seat latch for securing a cover and toilet seat assembly to a commode having holes formed therein for attachment of the seat assembly thereto, the seat assembly having first pivot pins enabling raising and lowering of the cover and of the toilet seat, said seat latch comprising:

gripping elements for penetrating the holes formed in the commode, said gripping elements being laterally and selectively movable with respect to the holes, wherein said gripping elements are locked within said holes by clamping action, and released therefrom;

control means for moving said gripping elements laterally, comprising a lever selectively movable to locked and detente positions and linkage connecting said lever to said gripping elements, causing said gripping elements to clamp the commode and to release the commode responsive to said lever being moved to said locked and detente positions, thus causing said clamping action; and seat attachment means for attaching said seat latch to the seat assembly.

2. The seat latch according to claim 1, said seat attachment means comprising means for engaging the first pivot pins, enabling the first pivot pins to rotate therein while securing the seat assembly to said seat latch.

3. The seat latch according to claim 1, wherein said control means move said gripping elements toward one another when being clamped.

4. The seat latch according to claim 1, wherein said gripping elements have lateral projections opposing withdrawal from the holes by interference fit when said gripping elements are in the clamped position.

5. The seat latch according to claim 1, said linkage transferring motion from said lever to said gripping elements at a reduction ratio, whereby said lever has leverage over said gripping elements.

6. The seat latch according to claim 1, further comprising a frame member forming a track, said gripping elements having slides constrained to be linearly aligned therewithin and to slide toward and away from one another when moved to clamped and released positions.

7. The seat latch according to claim 6, there further being a second pivot pin engaging said lever and said frame member, said second pivot pin pivotally anchoring said lever to said frame member, said linkage including a link pivotally connected at one end to said lever and at the other end having a slide engaging pin pivotally engaging one of said gripping elements, there being a third pivot pin connecting said link to said lever, said third pivot pin engaging said lever at a point between said second pivot pin and said slide engaging pin, there being a line defined between said second pivot pin and said slide engaging pin, said slide engaging pin movable to a point located selectively above, below, and on said line, said third pivot pin being located vertically below said line when said gripping elements are disposed in the clamped position.

8. A seat latch for securing a cover and toilet seat assembly to a commode having holes formed therein for attachment of the seat assembly thereto, the seat assembly having first pivot pins enabling raising and lowering of the cover and of the toilet seat, said seat latch comprising:

gripping elements for penetrating the holes formed in the commode, said gripping elements being laterally and selectively movable with respect to the holes, wherein said gripping elements are locked within said holes by clamping action, and released therefrom;

control means for moving said gripping elements laterally, comprising a lever selectively movable to engaged and detente positions, and linkage connecting said lever to said gripping elements, causing said gripping elements to move laterally responsive to said lever being moved to said engaged and said detente positions, thus causing said clamping action; and seat attachment means for attaching said seat latch to the seat assembly comprising means for engaging the first pivot pins, enabling the first pivot pins to rotate therein while securing the seat assembly to said seat latch.

9. The seat latch according to claim 8, wherein said control means move said gripping elements toward one another when clamping to the commode.

10. The seat latch according to claim 9, wherein said gripping elements have lateral projections opposing withdrawal from the holes by interference fit when said gripping elements are in the clamped position.

11. The seat latch according to claim 9, said linkage transferring motion from said lever to said gripping elements at a reduction ratio, whereby said lever has leverage over said gripping elements.

12. The seat latch according to claim 9, further comprising a frame member forming a track, said gripping elements having slides constrained to be linearly aligned therewithin and to slide toward and away from one another when moved to clamped and released positions.

13. The seat latch according to claim 12, there further being a second pivot pin engaging said lever and said frame member, said lever anchored to said frame member at said second pivot pin, and a slide engaging pin, there being a line defined by said second pivot pin, said linkage including a link having a third pivot pin engaging said lever at a point between said second pivot pin and said slide engaging pin, said third pivot pin movable to a point located selectively above, below, and on said line, said third pivot pin being located vertically below said line when said gripping elements are disposed in the clamped position.

14. A seat latch for securing a cover and toilet seat assembly to a commode having holes formed therein for attachment of the seat assembly thereto, the seat assembly having first pivot pins enabling raising and lowering of the cover and of the toilet seat, said seat latch comprising:

gripping elements for penetrating the holes formed in the commode, said gripping elements having lateral projections opposing withdrawal from the holes by interference fit when said gripping elements are in the clamped position, and being laterally and selectively movable with respect to the holes, wherein said gripping elements are locked within said holes by clamping action, and released therefrom;

control means for moving said gripping elements toward one another when clamping to the commode, comprising a lever selectively movable to engaged and detente positions, and linkage connecting said lever to said gripping elements, said linkage causing said gripping elements to move laterally responsive to said lever being moved to said engaged and said detente positions, thus causing said clamping action;

seat attachment means for attaching said seat latch to the seat assembly comprising means for engaging the first pivot pins, enabling the first pivot pins to rotate therein while securing the seat assembly to said seat latch;

a frame member forming a track, said gripping elements having slides constrained to be linearly aligned therewithin and to slide toward and away from one another when moved to clamped and released positions, there further being a second pivot pin engaging said lever and said frame member, said lever anchored to said frame member at said second pivot pin, and a slide engaging pin, there being a line defined by said second pivot pin, said linkage including a link having a third pivot pin engaging said lever at a point between said second pivot pin and said slide engaging pin, said third pivot pin movable to a point located selectively above, below, and on said line, said third pivot pin being located vertically below said line when said gripping elements are disposed in the clamped position.

15. The seat latch according to claim 14, said linkage having means for transferring motion from said lever to said gripping elements at a reduction ratio, whereby said lever has leverage over said gripping elements.

* * * * *